US005957278A

United States Patent [19]

Krawec et al.

[11] Patent Number: 5,957,278

[45] **Date of Patent: *Sep. 28, 1999**

[54] CONTAINER FOR FILTER TIPPED CIGARETTE TUBES USED IN HAND MADE CIGARETTES

[75] Inventors: Marek S. Krawec, Richmond Hill; Edward G. A. Simpson, Aurora, both of Canada

[73] Assignee: Rothmans, Benson & Hedges, Inc., Ontario, Canada

[ * ] Notice: This patent is subject to a terminal disclaimer.

[21] Appl. No.: 09/064,724

[22] Filed: Apr. 23, 1998

[30] Foreign Application Priority Data

Apr. 24, 1997 [CA] Canada ..... 2203596

[51] Int. Cl.[6] ..... B65D 85/10

[52] U.S. Cl. ..... 206/223; 206/236; 206/256; 312/31.1

[58] Field of Search ..... 206/223, 236, 206/237, 256, 257, 270; 312/31.1

[56] References Cited

U.S. PATENT DOCUMENTS

| | | | |
|---|---|---|---|
| 1,108,005 | 8/1914 | Rey | 206/256 |
| 1,224,996 | 5/1917 | Baldwin | 206/256 |
| 1,904,777 | 4/1933 | Brzezicki . | |
| 1,938,384 | 12/1933 | Hauch | 312/31.1 |
| 1,938,385 | 12/1933 | Hauch . | |
| 2,051,777 | 8/1936 | Purinton et al. . | |
| 2,559,297 | 7/1951 | Hasbrook et al. . | |
| 3,144,152 | 8/1964 | Kopp . | |
| 3,547,303 | 12/1970 | Mascia et al. | 206/256 |
| 4,771,793 | 9/1988 | Kastner . | |
| 5,794,771 | 8/1998 | Krawec et al. | 206/256 |

FOREIGN PATENT DOCUMENTS

| | | |
|---|---|---|
| 0 097 895 | 1/1984 | European Pat. Off. . |
| 214920 | 5/1924 | United Kingdom . |
| 2 033 344 | 5/1980 | United Kingdom . |

*Primary Examiner*—Jim Foster
*Attorney, Agent, or Firm*—Banner & Witcoff, Ltd.

[57] ABSTRACT

A cigarette tube container for containing and transporting a multiple of cigarette tubes having cigarette filter tips is provided the container has partitions for dividing the container space into multiple segments with the tubes being placed upright with the filter tips located at the top of the container and a closure for each segment of the container where each closure may be individually opened to permit withdrawal of the cigarette tube by its filter tip.

7 Claims, 3 Drawing Sheets

24
14
22
40
38
34
32
30
36
20
68
16
18
10
28
12
42
26

CONTAINER FOR FILTER TIPPED CIGARETTE TUBES USED IN HAND MADE CIGARETTES

SCOPE OF THE INVENTION

This invention relates to a container for filter tipped cigarette tubes for use in a packaging system for fine cut tobacco and such tubes. The packaging system includes a reusable canister in which loose fine cut tobacco may be provided in the bottom. Preferably, a removable divider separates the loose tobacco from the container of cigarette tubes placed on top of the divider. The container is preferably inverted in the canister so that the tubes are supported by their filter tips resting on the container top of the inverted container. The cigarette tube container interior is preferably divided into segments where each segment contains a limited number of tubes. The top of the package may have a limited access to permit withdrawal of one cigarette tube at a time where such individual withdrawal minimizes tube damage.

BACKGROUND OF THE INVENTION

There are several well recognized advantages in hand made cigarettes. Aside from the obvious cost advantage, hand made cigarettes offer the consumer the opportunity to customize the cigarette to their own preference for tobacco weight, firmness, draw resistance and the like. Two drawbacks associated with hand made cigarettes are the inability or difficulty in positioning of a filter on the end of the hand made cigarette and the appearance. These two problems were overcome by pre-made filter tipped cigarette tubes which can be loaded with tobacco by use of, for example, a device described in U.S. Pat. No. 4,771,793 and sold under the trade-mark SUSSEX.

A convenient kit for packaging loose tobacco and cigarette tubes comprises the tobacco in a separate foil sealed container and a box or boxes of filter tipped cigarette tubes. The tobacco container includes a separate lid with optional moistening strip where the foil seal once removed is discarded. The cigarette tubes are stored in rows, lying flat in the boxes. The tobacco container and boxes are packaged together in a kit. The tobacco container and boxes can of course be separated and hence, misplaced. The box of cigarette tubes is normally of light paper weight construction which can be crushed.

The step of loading the tobacco into the cigarette tube filling device can result in considerable mess and wasted loose tobacco because the container for the loose tobacco is of a size to only accommodate the tobacco. On pulling tobacco from the container for use in the filling device, spillage of tobacco outside of the container can result.

In accordance with this invention, a cigarette tube container for use in a packaging system is provided which overcomes several of the above problems and provides many unexpected advantages over these prior art systems.

SUMMARY OF THE INVENTION

In accordance with an aspect of the invention, a cigarette tube container for containing and transporting a multiple of cigarette tubes having cigarette filter tips, said container comprises:

i) a container sidewall, top and bottom;

ii) a partition means for dividing space within said container into multiple segments wherein a predetermined number of said multiple of cigarette tubes may be placed;

iii) the cigarette tubes being placed upright in said segments with said filter tips at the top of said container;

iv) a closure for each segment of said container where each closure may be individually opened to permit withdrawal of said cigarette tube by its filter tip.

In accordance with another aspect of the invention, a fine cut tobacco canister comprises fine cut tobacco in its base; a divider on top of said fine cut tobacco and an inverted cigarette tube container of the above aspect, with its top resting on said divider, the lifting means on the container being accessible in said tobacco canister.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
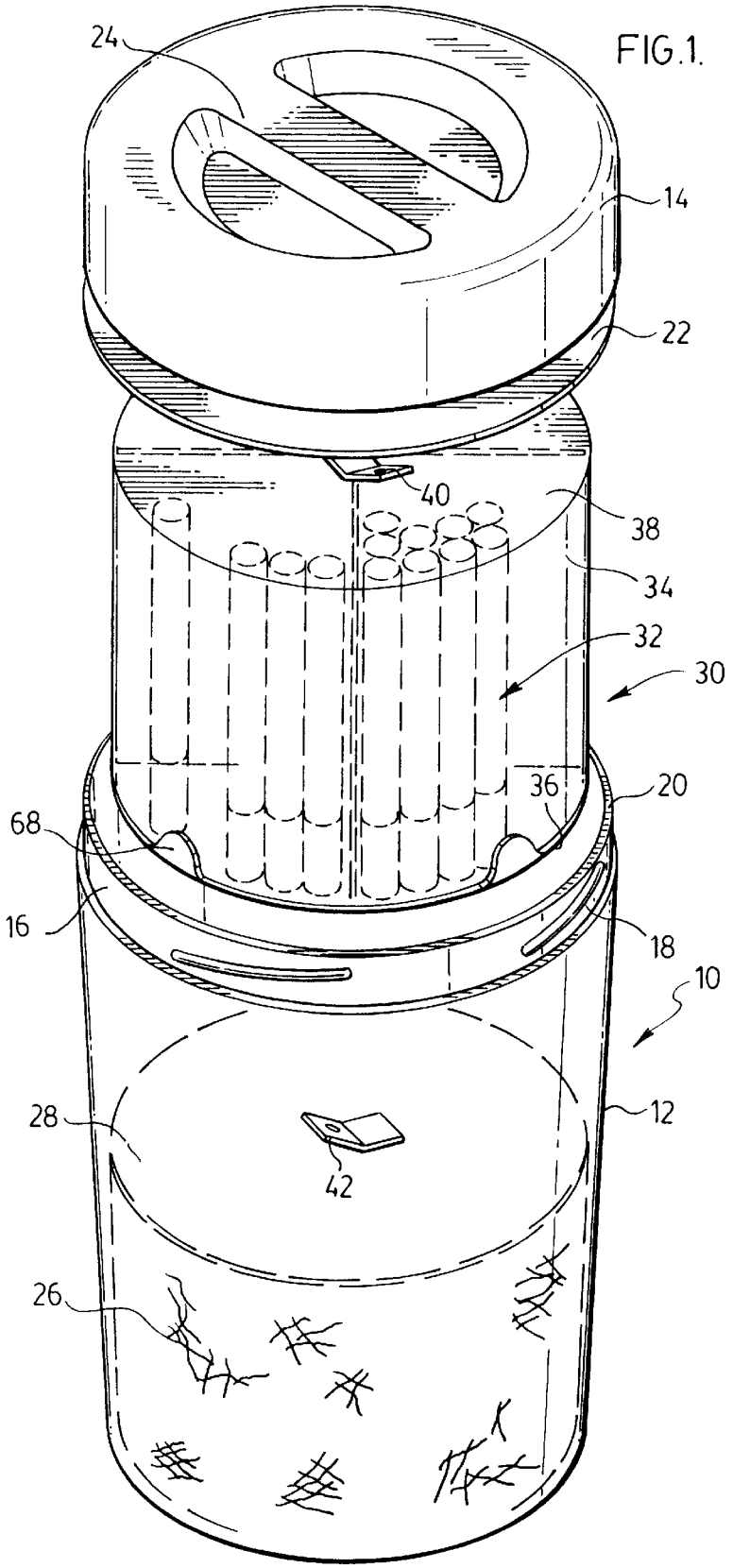
FIG. 1 is an exploded perspective view of the canister for loose tobacco and container of cigarette tubes.

A preferred embodiment of the packaging system of this invention is shown in FIG. 1. The packaging system 10 has a canister tub 12 and a twist-on canister lid 14. The tub 12 has a neck portion 16 with threads 18 for engaging the lid 14 to permit secure fastening of the lid to the tub. The neck 16 has an upper rim 20 which permits the heat sealing thereto of a suitable moisture, vapour and gas barrier or foil 22. The lid 14 during shipping is threaded onto the neck 16 over top of the barrier 22. The lid 14 includes a handle portion 24 which facilitates unthreading of the lid and removal from the tub. The tub has the fine cut loose tobacco charge 26 provided in the bottom thereof where preferably a suitable divider 28 is positioned on top of the tobacco charge.

A container 30 is provided for the pre-made filter tip cigarette tubes 32. The container 30 has a crush-proof wall 34 where the container is preferably inverted in the canister tub 12, with top wall 36 lowermost and bottom wall 38 uppermost. The cigarette tube container 30 is lowered into the tub 12 to rest on top of the divider 28. It is understood that if the divider is not used, the container 30 may rest directly on top of the tobacco 26. In order to remove the cigarette tube container from the tub 12, the seal 22 is broken after the lid 14 is removed. The cigarette tube container 30 is removed from the tub by grasping the lifting means in the preferred shape of handpull 40. In order to gain access to the tobacco 26, the divider 28 is removed by grasping handpull 42. It is appreciated that the handpulls 40 or 42 may be of a variety of configurations for the lifting means while facilitating withdrawal of the container or divider when the tub 12 is in the upright position. It is also appreciated that the container could also be removed by pinching its upper edge and removing the container. The same technique may be used in removing the divider 28.

Figure 2:
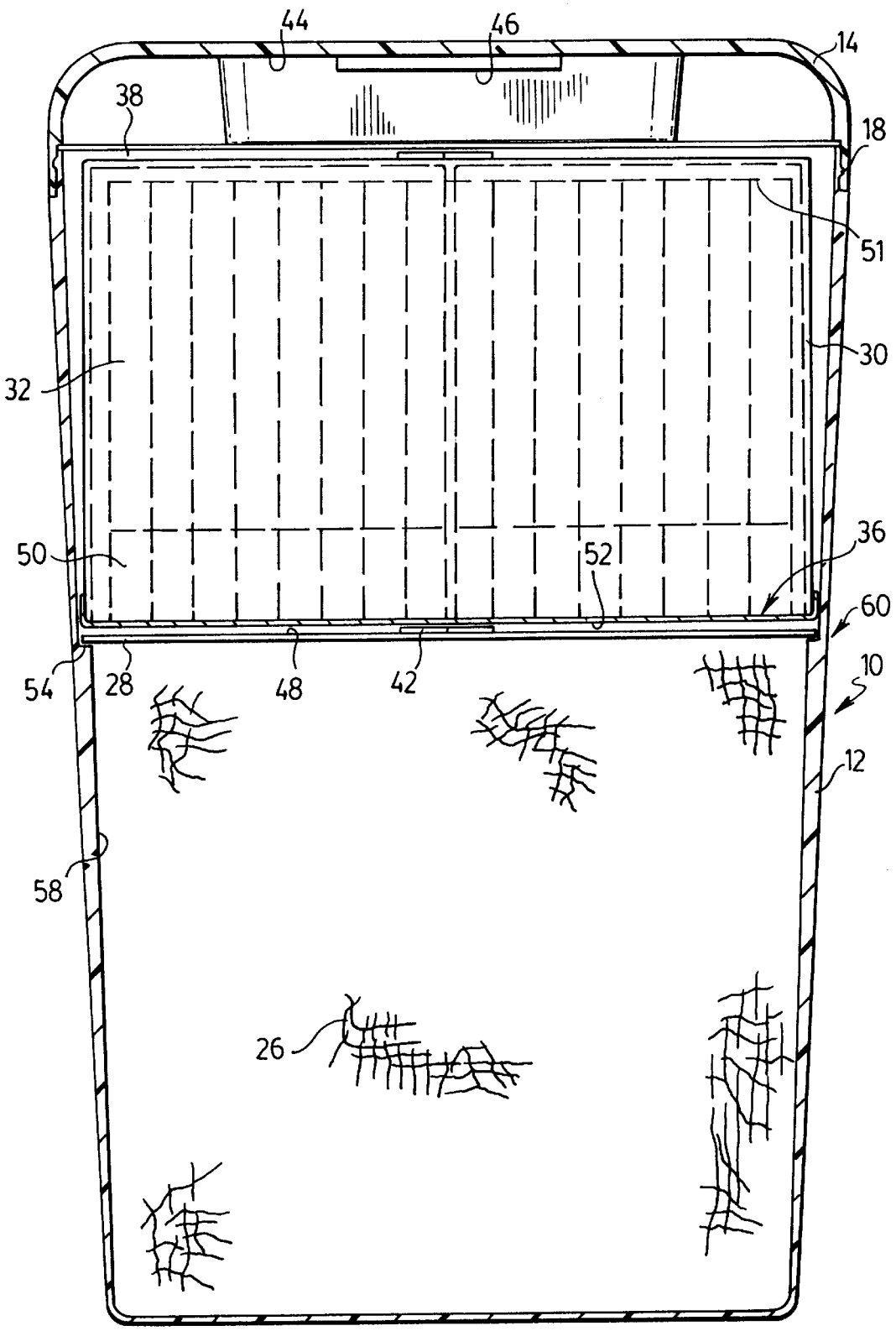
FIG. 2 is a section through the assembled canister of FIG. 1.

The assembled packaging system 10 is shown in FIG. 2 where the lid 14 is secured to the container tub 12 by threaded engagement at 18. On the underside 44 of the lid within handle 24 is a pad of water absorbent material 46. After the canister is opened, a few drops of water or flavourant may be placed on the pad 46 to keep the moisture content at the desired level to ensure that the tobacco 26 does not dry out. The cigarette tube container 30 rests on top of or above the divider 28 whereby pull 42 is compressed against the upper face 48 of the divider. In accordance with this embodiment, the divider 28 may rest on an annular shoulder 54 provided in the interior wall 58 of the tub in region 60. The height of the canister tub 12 is such that when the inverted container 30 is resting on the upper face 48 of the divider 28, the bottom 38 of container is below the level of the seal 22.

The individual cigarette tubes are stacked in the container 30. Assuming that the container is lying flat, the tubes are stacked in a vertical or upright orientation, that is they extend in a direction parallel to the longitudinal axis of the container. The multiple tubes may be positioned with the cigarette filter tip portion 50 being uppermost in the container 30 when the container is positioned in the canister or lowermost in the container. Such orientation of the cigarette tubes depends to some extent on the type of container used and how access is provided to the tubes after the container is removed from the canister. In accordance with the particular embodiment shown in FIG. 2, the individual cigarette tubes 32 have their filter tip portions 50 resting on the top wall 36 of inverted container 30. During shipping, storage and handling of the container 10, the structurally stronger filter tip portion 50 of each cigarette tube supports the weight of the tube and hence, avoids crushing or misconfiguration of the much weaker cigarette tube open end 51.

The outer perimeter dimensions of the top 36 of the inverted container 30 is less than the inner diameter of the lower portion 56 of the tub 12 to permit placement of or resting of the container in the canister 12. Ideally, after the canister is opened, the divider 28 is discarded. Should one wish to store the cigarette tubes to avoid accidental crushing of the tubes or misplacement of the tubes, the tube container 30 can simply be placed back in the tub 12 to rest on top of the remaining tobacco 26. As the tobacco level decreases in the container, the cigarette tube container 30 slides down further within the tub 12 without binding and becoming stuck therein. Alternatively, the divider 28 may be retained and placed back in the tub on the shoulder 54 to support the cigarette tube container 30 in the inverted position above the loose tobacco.

The cigarette tube container 30 may be opened at its top 36 or bottom 38 in order to permit access to the cigarette tubes. In order to minimize tube open end damage, if the container is opened at its bottom 38, it is preferred that the bottom 38 come off in its entirety. This permits dumping of the tubes on a work surface so that they may be carefully picked up individually and loaded with tobacco. Alternately, the container may be opened at its top 36 to permit individual tube withdrawal by grasping the sturdier tube filter tip and extracting the tube from the container 30 in its now upright position. The opening for the container bottom 38 or top 36 may be in the form of a removable lid, a removal foil or the like.

Figure 3:
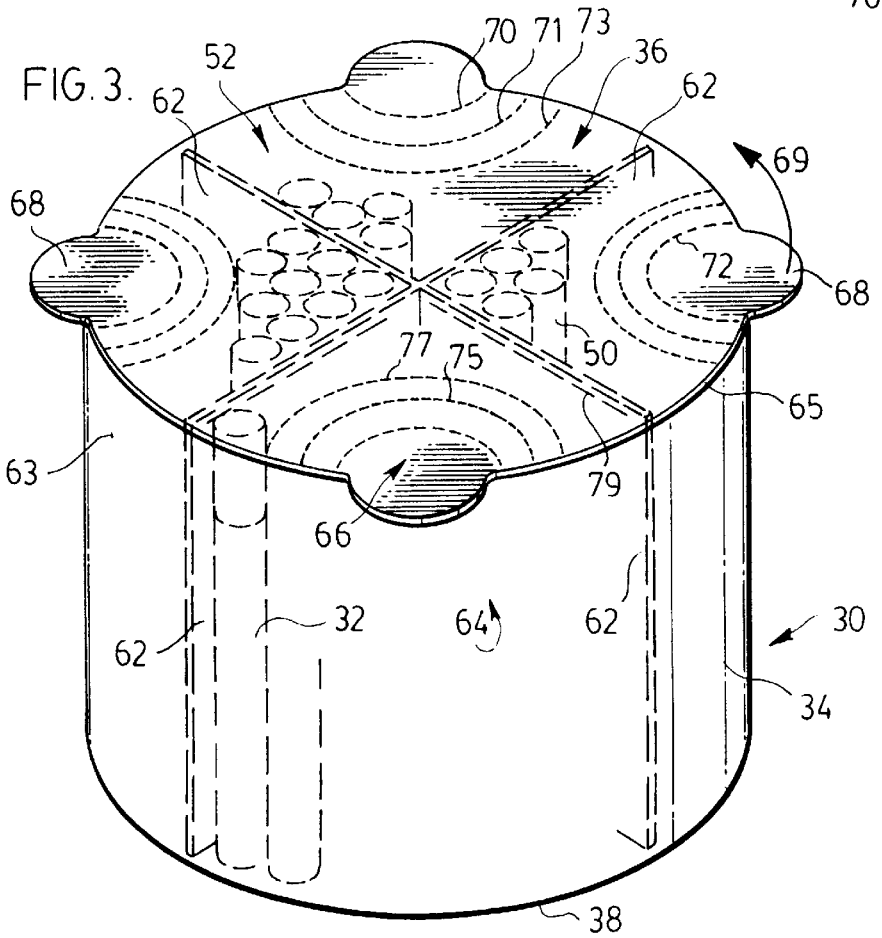
FIG. 3 is a perspective view of the cigarette tube container.

With reference to FIG. 3, further details of the cigarette tube container 30 are shown. The package wall 34 is preferably of a crush resistant plastic material, that is at least the sidewall 34 and bottom 38 have sufficient strength to prevent crushing of the contained cigarette tubes 32 when the container is picked up by hand. The container may be constructed of heavy card stock, stamped aluminum, vacuum formed thermoplastic or injection molded plastic. The plastic may be transparent to permit viewing of the tubes in the container or of translucent or opaque plastics.

To facilitate dispensing of the cigarette tube 32 from the container 30, several embodiments are contemplated. The container 30 may be extracted from the canister tub 12 by use of the pull tab 40. The container is re-inverted to expose the container top 36. The interior of the container 30 has partition means such as dividers 62 which divide the interior space 63 into a plurality of segments 64. A predetermined number of cigarette tubes 32 are positioned within each segment 64 of the container 30. Usually, a corresponding fraction of the total number of cigarette tubes required to make up the loose tobacco, is provided in each segment. Preferably, there are a sufficient number of dividers 62 to provide a desired number of tubes for each days consumption.

Figure 4:
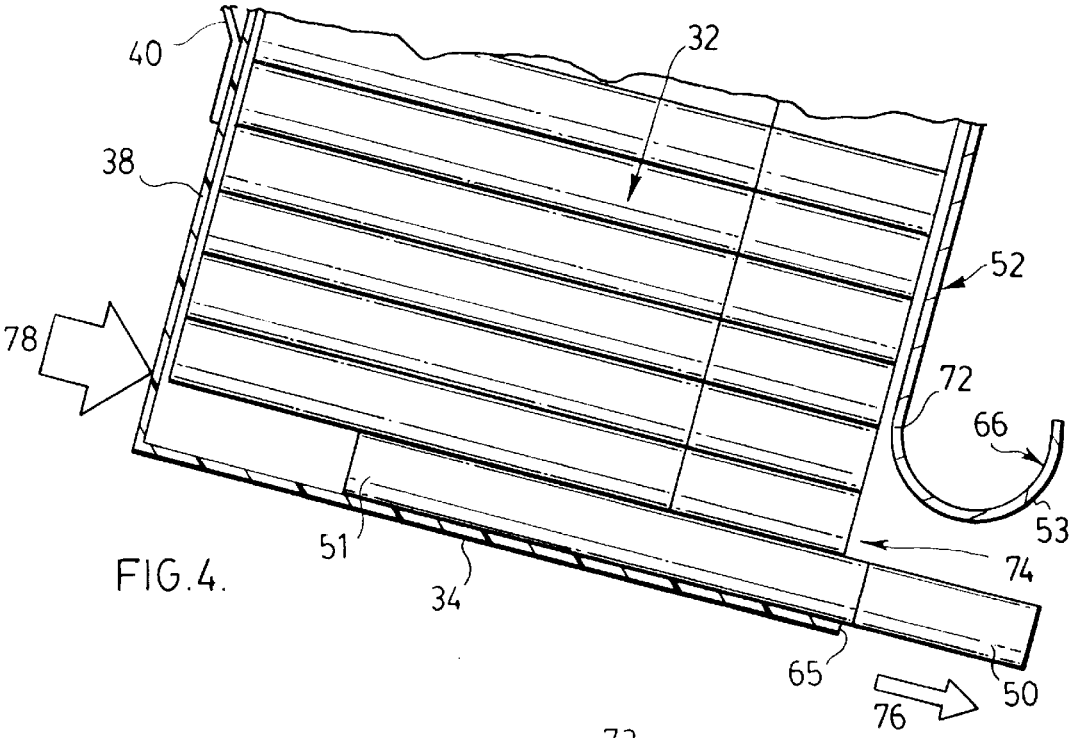
FIG. 4 shows the membrane portion on the top removed to allow restricted access to the cigarette tubes.

In accordance with this particular embodiment, the dividers 62 divide the container interior 63 into four segments 64 which are roughly pie shaped. Assuming that 200 cigarettes are made from each charge of tobacco, at least 50 cigarette tubes are then positioned in each segment 64. The top 36 for the container 30 may be a removable lid, a rotary dispenser lid with an opening provided therein or the like. Rotation of the rotary dispenser lid may be stepped so that its opening is aligned with each segment 64 as it is rotated. The lid 36 may also be a single sheet of for example, foil heat sealed to the rim portion 65 of the container 30. Other lid arrangements include snap on tops, slip on lid with polypropylene seal or the like. The foil is removed from the rim 65 to expose all of the cigarette tubes at once. Alternatively, the foil may be perforated to provide openings of selected size for each segment 64. In accordance with this particular embodiment, as shown in FIGS. 3 and 4, a tear out portion 66 is provided which when pulled back allows access to the corresponding segment 64. The foil 52 has one or more arcuate shaped perforations 70 formed therein for each segment. In order to provide for a varying size of opening as needed for each segment there are additional perforations 71 and 73 which allow the consumer to select the size of opening for access to the cigarette tubes. Each tear out 66 is provided with a finger tab 68 which allows the consumer to rip the tab upwardly in the direction of arrow 69 and tear the foil along the respective perforations 70, 71 or 73 back to its inner connected part at 72, 75 or 77. Alternatively, the perforations 70, 71 or 73 extend around the entirety of the arc so that the foil tear out may be completely removed. There are situations, however, where it may be desired to reseal the opening. The foil may include some type of resealing feature on its underside 53, so that when the foil is brought back down onto the rim, the opening is at least partly closed. Should one desire access to the entire segment 64, a further alternative perforation 79 may be provided. When the tab is pulled and the foil torn along perforation 79, the entire segment 64 is now open.

When the consumer wishes access to a particular segment, the tab is lifted upwardly to expose the filter tip portions of the cigarette tubes within that particular segment. The container may be tipped sideways as shown in FIG. 4 to facilitate dispensing or withdrawal of the cigarette tubes from the particular segment. The tab 66 is flexed backwards in region 72 where the tab 66 remains integral with the foil 52. Individual cigarette tubes 32 may be extracted from the container 30 through the formed opening 74 in the direction of arrow 76. By selecting a suitable size of the opening 74, the container 30 may be turned on its side and tapped lightly at 78 to advance one or two tubes outwardly of the segment so that the customer is able to grasp the tube 32 by its relatively sturdier filter tip 50. Because of the delicate nature of the preformed cigarette tubes, such dispensing is preferable. This approach avoids the customer having to grab the delicate open end 51 of the tube. Instead, one may grasp the sturdier filter tip 50 to permit handling of the tube and insertion in the hand cigarette making device. It is appreciated that when the tear tab 66 includes a sealing feature, the tubes are not jostled out of the container 30 when the container 30 is placed back in the tub 12. Such arrangement provides protection of the tubes until the next time cigarettes are to be made.

The partitioning means, preferably, divider 62 may be integrally formed with the container wall and bottom, particularly if the unit is injection molded. As previously noted, the purpose of the dividers is to prevent the tubes from falling over within the container after some of the tubes are extracted. It is appreciated that aside from the dividers, other devices may be positioned within the interior space 63 of the container to maintain the tubes in an upright position as they are dispensed. For example, after the full container is withdrawn from the canister there may be only one access opening where internally a spring loaded device or the like advances the tubes towards that opening as they are withdrawn. Such spring loaded device would prevent the tubes from falling over. A further embodiment would be to provide a honey comb like structure within the interior of the container where each tube is positioned in a respective honey comb cell. The honey comb structure may be made of inexpensive plastic or card material and which would readily serve to protect the tubes until use. This arrangement would allow for a single lid to be provided on the container top.

Many advantages and features flow from this cigarette tube container. During storage and transport the cigarette tubes are protected by resting on their stronger filter tip portions resting on the underside of the top of the inverted container. When the container is removed, it is inverted and a tab pulled open to expose just a portion of the provided segment to allow careful controlled extraction of individual or at the most two or three cigarette tubes at a time from that container segment. The container in providing segmented positioning of the cigarette tubes in the container allows the container to be placed back in the tub for protection of the tubes while at the same time preventing all of the tubes falling over in the container and becoming disarrayed. Even if some of the tubes in the segment fall over or tilt in that segment, as soon as, the container is tapped on its side the tubes become realigned and one or two of them gently advance out through the opening so that the filter tip portion may be grasped and placed in a cigarette making device. Once cigarettes are made, they may be stored in the container and placed in the canister to maintain desired moisture level in the cigarette by way of the moisture pad.

Although preferred embodiments of the invention have been described herein in detail, it will be understood by those skilled in the art that variations may be made thereto without departing from the spirit of the invention.

We claim:

1. A cigarette tube container for containing and transporting a multiple of cigarette tubes having cigarette filter tips, said container comprising:

i) a container sidewall, top and bottom;

ii) a partition means for dividing space within said container into multiple segments wherein a predetermined number of the multiple of cigarette tubes may be placed upright in said segments so that their filter tips can be positioned at the top of said container;

iii) a closure for each segment of said container where each closure may be individually opened to permit withdrawal of each cigarette tube by its filter tip;

iv) wherein said container bottom has a lifting means to permit transport of said container in an inverted position with the cigarette tubes resting on their filter tips.

2. A cigarette tube container of claim 1 wherein said partition means divides said container into said segments where each segment includes a corresponding portion of said sidewall, each said closure comprising a tear open portion with a tear tab overhanging said corresponding portion of said sidewall.

3. A cigarette tube container of claim 2 wherein each said closure has multiple tear off portions to enlarge as needed an access opening to said cigarette tubes.

4. A cigarette tube container of claim 1 wherein said closure for each segment has means for reclosing each segment.

5. A cigarette tube container of claim 2 wherein said container is circular, said closure when open permitting a user to tap said container bottom and withdraw a single cigarette tube.

6. A fine cut tobacco canister comprising a base containing fine cut tobacco; a divider on top of said fine cut tobacco and an inverted cigarette tube container of claim 1 with its top resting on said divider, said lifting means being accessible in said tobacco canister.

7. A fine cut tobacco canister of claim 6 wherein said canister has a recloseable lid.

* * * * *